US005120217A

United States Patent [19]

O'Brien et al.

[11] Patent Number: 5,120,217

[45] Date of Patent: Jun. 9, 1992

[54] ASPHALT RECLAMATION UNIT WITH DISCHARGE FEED AND IMPROVED HOT AIR FLOW

[76] Inventors: William J. O'Brien, P.O. Box 143, Goshen, Mass. 01032; Russell A. St. Louis, 905 L.H. Desjardins, Terrebonne Quebec, Canada, J6W 2X2; Anton H. Heller, deceased, late of Floral City; Julia Heller, executrix, P.O. Box 1090, Floral City, both of Fla. 32636

[21] Appl. No.: 418,146

[22] Filed: Oct. 6, 1989 (Under 37 CFR 1.47)

[51] Int. Cl.[5] ..... E01C 19/08; E01C 19/18

[52] U.S. Cl. ..... 432/120; 432/13; 432/156; 126/343.5 R; 126/391; 404/110; 404/111

[58] Field of Search ..... 432/13, 120, 156; 126/343.5 A, 343.5 R, 391; 404/110, 111

[56] References Cited

U.S. PATENT DOCUMENTS

| | | | |
|---|---|---|---|
| 2,267,978 | 12/1941 | Ionides | 404/111 |
| 3,386,435 | 6/1968 | Heller | 126/343.5 A |
| 3,577,976 | 5/1971 | Heller | 126/343.5 A |
| 3,633,563 | 1/1972 | Osborn et al. | 126/343.5 A |
| 3,942,944 | 3/1976 | Nielsen | 432/132 |
| 3,946,722 | 3/1976 | Banahan | 126/343.5 A |
| 4,192,288 | 3/1980 | Heller | 126/343.5 A |
| 4,196,827 | 4/1980 | Leafdale | 404/111 X |
| 4,311,408 | 1/1982 | Wren | 404/110 X |
| 4,418,681 | 12/1983 | Moody | 126/343.5 A X |
| 4,418,682 | 12/1983 | Heller | 126/343.5 A |
| 4,445,848 | 5/1984 | Heller | 126/343.5 A X |
| 4,511,284 | 4/1985 | Sterner | 404/111 |
| 4,695,186 | 9/1987 | King | 126/343.5 A X |
| 4,704,046 | 11/1987 | Yant | 404/110 X |

*Primary Examiner*—Albert J. Makay
*Assistant Examiner*—Christopher B. Kilner
*Attorney, Agent, or Firm*—Cooper & Dunham

[57] ABSTRACT

A unit for heating initially solid asphaltic material to provide asphaltic concrete in a condition suitable for application, including an inner enclosure defining a volume for containing the material to be heated, an outer enclosure surrounding and spaced from the inner enclosure to define a space beneath the inner enclosure and passages for heated air flow around the walls of the inner enclosure, a screw disposed in an open-top channel at the floor of the inner enclosure to move heated material, an opening in the inner enclosure floor in communication with a passage in the outer enclosure floor for delivery of heated asphaltic material moved by the screw to the unit exterior, heating chambers projecting upwardly from the floor of the inner enclosure above the heating sources to provide regions through which hot air rises from the sources, and flues extending transversely from the upper portions of the heating chamber to the end walls of the inner enclosure for conducting the heated air from the heating chambers to the aforementioned passages. The unit is operated to heat the initially cold material to a temperature between 275° and 300° F. and to maintain it at that temperature until it is used.

30 Claims, 5 Drawing Sheets

ASPHALT RECLAMATION UNIT WITH DISCHARGE FEED AND IMPROVED HOT AIR FLOW

BACKGROUND OF THE INVENTION

This invention relates to the provision of asphaltic concrete in a state or condition suitable for paving application or the like, and particularly to the production of asphaltic concrete in condition for application from initially solid asphaltic material. In a specific sense, the invention is directed to an asphalt reclamation unit for this purpose, and more particularly to such a unit having a discharge feed and improved hot air flow.

It is known to heat chunks or other pieces of initially solid, cold asphaltic material (i.e. asphaltic material initially at ambient atmospheric temperature) to provide asphaltic concrete for paving or like application, e.g. for patching. For example, useful asphaltic concrete can be reclaimed in this way from chunks of used asphaltic concrete paving. Desirably, the produced material should be a substantially homogeneous, soft or flowable mass capable of being spread easily and evenly to constitute a patch.

Prior procedures for reclaiming used asphaltic material have involved rapid heating. Difficulties associated with such prior practice have included excessive heating of the material, oxidation of the liquid component thereof, segregation of components, and/or burning. These disadvantages have led to nonhomogeneous or otherwise defective products.

U.S. Pat. Nos. 3,386,435 and 3,577,976, both assigned to the present assignee, describe units for storing materials such as asphaltic concrete at an elevated temperature. In these units, the asphaltic material is contained within an inner enclosure which is surrounded by an outer enclosure that defines spaces or passages beneath and on all sides of the inner enclosure. Air, heated by an infrared energy source beneath the inner enclosure, flows through these spaces and/or passages to minimize the thermal gradient across the wall of the inner enclosure and thereby to retard heat loss from the contained hot asphalt. The rising heated air is introduced to the top of the inner enclosure through plural horizontally spaced apertures arranged to provide a flow of heated air across the top of the contained asphalt, for further minimizing the heat loss. As will be understood from the cited patents, the purpose of these structures is primarily to maintain the elevated temperature of a charge of asphaltic material supplied to the inner enclosure in initially heated condition, and not to heat an initially cold charge to a suitable temperature for application.

U.S. Pat. No. 2,496,113 describes a heater melting bituminous material wherein heated gas is passed through an essentially horizontal flue system extending within or beneath the charge of material to be heated and is then conducted upwardly at one end of the heater so as to be directed across the surface of the charge.

U.S. Pat. No. 4,418,682 and related U.S. Pat. No. 4,445,848, both assigned to the present assignee, disclose an asphaltic reclamation unit having inner and outer enclosures spaced from each other to form passageways therebetween to provide a gas space for heated air to flow from a heating source. Unheated asphaltic material is loaded into the open top of the unit and is heated and removed by way of doors at the back wall of the unit. The front wall in such units slopes upwardly so that the material collects at the back. This arrangement limits the capacity of the reclaimer, and the material is removed manually.

SUMMARY OF THE INVENTION

It is now found that asphaltic concrete in suitable condition for paving application or the like can be provided from initially cold asphaltic material by heating the material, relatively slowly, to a temperature between about 275° and about 300° F., and maintaining it at that temperature until it is used. Such heating operation avoids overheating, segregation, oxidation, or ignition of components of the asphaltic material, and provides a very satisfactory product.

The present invention contemplates the provision of an asphalt reclamation unit for heating cold asphaltic material. The unit includes an upwardly open inner enclosure defining a volume for containing asphaltic material to be heated, and having a floor, end walls, and side walls; and an outer enclosure surrounding the inner enclosure and having a floor, end walls, and side walls respectively disposed in spaced relation to the floor, end walls, and side walls of the inner enclosure to define a gas space between at least a portion of the inner and outer enclosure floors, and end and side wall gas passages between the inner enclosure walls and the outer enclosure walls respectively adjacent thereto. The outer enclosure also has door means for closing the top of the unit. The gas space communicates with the outside atmosphere, the passages communicate with the gas space and are vented to the outside atmosphere, for enabling continuous air flow into the gas space and thence through the passages and to the outside atmosphere. The unit has at least one source of energy for providing heated air from the outside atmosphere to the gas region.

As a particular feature of the invention, the unit includes a conveyor or discharge feed means disposed in the floor of the inner enclosure for transporting asphaltic material across at least a portion of the inner enclosure floor. An opening is also provided in the floor of the inner enclosure and passage means are provided through the floor in the outer enclosure, to provide an outlet communication passage for delivery of the heated asphaltic material from the conveyer means to the exterior of the unit.

The conveyor means preferably is in the form of a screw discharge feed disposed from front to back and located centrally between both sides of the inner enclosure. The discharge feed is in the form of a screw which is enclosed in a circular tubular channel formed in the floor of the inner enclosure, which channel has an open top for receiving asphaltic material. A motor is provided for selectively driving the screw to move the asphaltic material rearwardly. The opening in the floor of the inner enclosure is preferably in the form of a sliding door, disposed horizontally, and located at the rear of the unit. The floor of the inner enclosure has two downwardly sloping portions to gravity feed the asphaltic material into the screw channel. The bottom of the screw channel is spaced from the floor of the outer enclosure so that hot air may flow from one side of the floor of the inner enclosure, underneath the screw channel, to the other side of the inner enclosure floor.

The unit preferably includes at least one heating chamber projecting upwardly from the floor of the inner enclosure into an upper portion of the aforementioned volume at a locality intermediate and spaced from the end walls of the inner enclosure, the heating chamber comprising thermally conductive wall portions defining a gas flow region isolated by the wall portions from the volume and opening into and extending upwardly from the gas space above the energy source; and flue means for conducting heated air from an upper locality in the gas flow region frontwardly across the upper portion of the volume to the end wall passages, such that air heated by this source flows upwardly through the gas flow region and thence through the flue means to the end wall passages. Preferably, the unit has a plurality (at least two) of such heating chambers, extending from side to side of the inner enclosure in spaced relation to each other, with a separate energy source disposed beneath each heating chamber. Preferably, also, the flue means comprises at least two front to back flues, extending between the end walls of the inner enclosure in horizontally spaced relation to each other, and each communicating with each of the heating chambers. As an additional particular feature of the invention, heat-shielding means are interposed between each energy source and the inner enclosure, for preventing local overheating of portions of the asphaltic material charge adjacent that source.

The present invention also provides an asphalt reclamation unit having improved hot air flow for heating asphaltic material, by providing means, located in the uppermost portion of an asphaltic material receiving and holding volume, for directing heated air downwardly into said volume. The means for directing heated air may be in the form of a louver cover mounted on the upper side and/or end walls, and/or on the top door.

Other features provided by the invention include a moveable exterior power driven discharge screw means, doors provided on the lower portion of the sidewalls of the outer enclosure to enable one to access the lower gas region, and a wastes bin having a retractable door arrangement. A ladder is also preferably mounted, on the exterior of the outer enclosure, connecting to a platform mounted on the upper exterior of the outer enclosure to give an operator access to and visual inspection of the inner enclosure volume when the outer enclosure doors are open.

Further features and advantages of the invention will be apparent from the detailed description hereinbelow set forth, together with the accompanying drawing.

DETAILED DESCRIPTION

Figure 1:
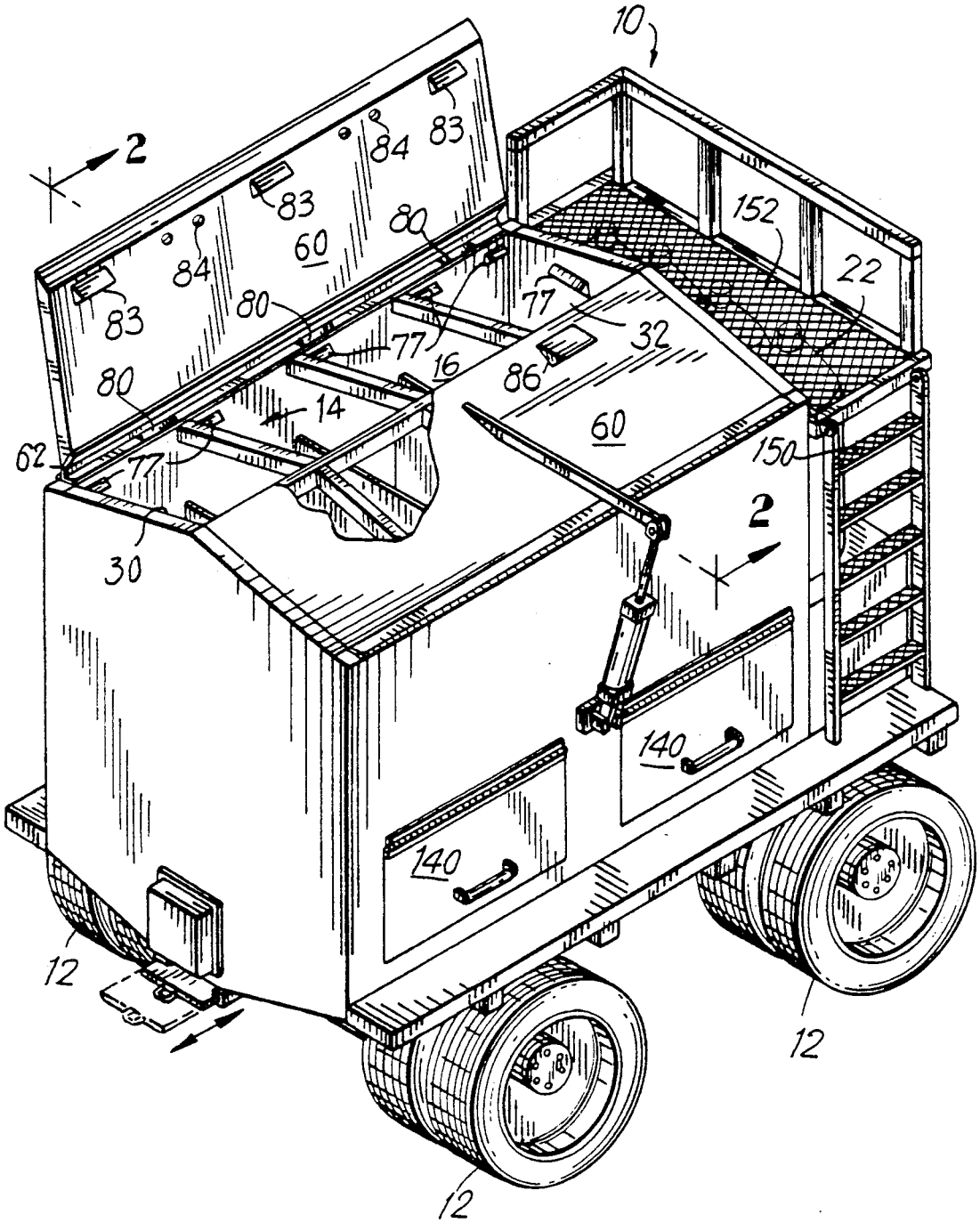
FIG. 1 is an overhead perspective view of an illustrative embodiment of the apparatus of the invention.

Referring to the drawings, there is shown an asphalt reclamation unit similar in many ways to the reclamation unit disclosed in U.S. Pat. No. 4,418,682 which is incorporated by reference herein. The unit 10, embodying the invention in a particular form, is shown supported on wheels 12 and having a forwardly extending frame with a front end (not shown) designed to be coupled to a vehicle such as a truck, tractor, or the like so that the unit can be drawn as a trailer. Alternately, the unit can be mounted to a truck chasis either premanently or in an arrangement where it can be removed in a manner like a roll-off dumpster or the like. A conventional device (also not shown) is provided at the front end of the frame for supporting the unit in stationary, level position when unhitched from the towing vehicle.

The unit 10 broadly comprises an upwardly open inner enclosure 14 defining a volume 16 containing a quantity of initially solid asphaltic material (not shown), e.g. lumps or other pieces of used asphalt pavement supplied to the volume 16 at ambient atmospheric temperature; an outer enclosure 18 essentially completely surrounding the inner enclosure in outwardly spaced relation thereto; and means 20 for heating the contained asphaltic material to produce asphaltic concrete in a state suitable for paving application. Propane gas tanks 22 are removably secured side by side ahead of the outer enclosure 18 to supply fuel to the heating means, which, in the illustrated embodiment, comprise so-called infrared energy converters constituting horizontally elongated sources of infrared energy heated by burners fueled by the propane gas from the tanks.

The inner enclosure 14 includes a bottom wall or floor having two downwardly sloping portions, 24*a* and 24*b*, a pair of opposed vertical side walls 26 and 28 joined to and respectively rising from the floor portions 24*a* and 24*b*, a vertical rear end wall 30, and a vertical front end wall 32. The floor and walls of the enclosure 14 are fabricated of a thermally conductive metal to facilitate heating of the contained asphaltic material (which is in direct contact with the interior surfaces of the floor and walls) by heated gas, i.e. air, circulating past the exterior surfaces of the floor and walls as hereinafter further described.

The outer enclosure 18 has a generally horizontal bottom wall or floor 36 spaced below the inner enclosure floor to define a gas space 38 therebetween, extending beneath the full width of the inner enclosure floor and containing the infrared energy converters 20. Six such energy converters are provided, each having about a 50,000 B.T.U. heat output. In addition, the enclosure 18 includes opposed side walls 42 and 44 rising vertically from the floor 36 in outwardly spaced relation to the inner enclosure side walls 26 and 28 to define therewith side gas passages 46 and 48; a vertical rear end wall 50 extending between the side walls 42 and 44 and spaced outwardly of the wall 30 to define therewith a rear end gas passage 52 communicating laterally with passages 46 and 48; and a front end vertical wall 54 in spaced relation to the wall 32 to define therewith a front end gas passage 56, which at its lower end communicates directly with the gas space 38, and also communicates laterally with the passages 46 and 48.

At its top, the outer enclosure 18 is provided with movable lid means comprising a pair of loading doors 60 respectively secured by hinges 62 to the top edge portions of the side walls 42 and 44 and cooperatively constituting a peaked roof for the unit 10. The loading doors, when shut, cover and complete the enclosure of the volume 16. The doors are opened by pivotally mounted, hydraulic cylinders 64 to enable the volume 16 to be filled with asphaltic material to be heated.

Figure 2:
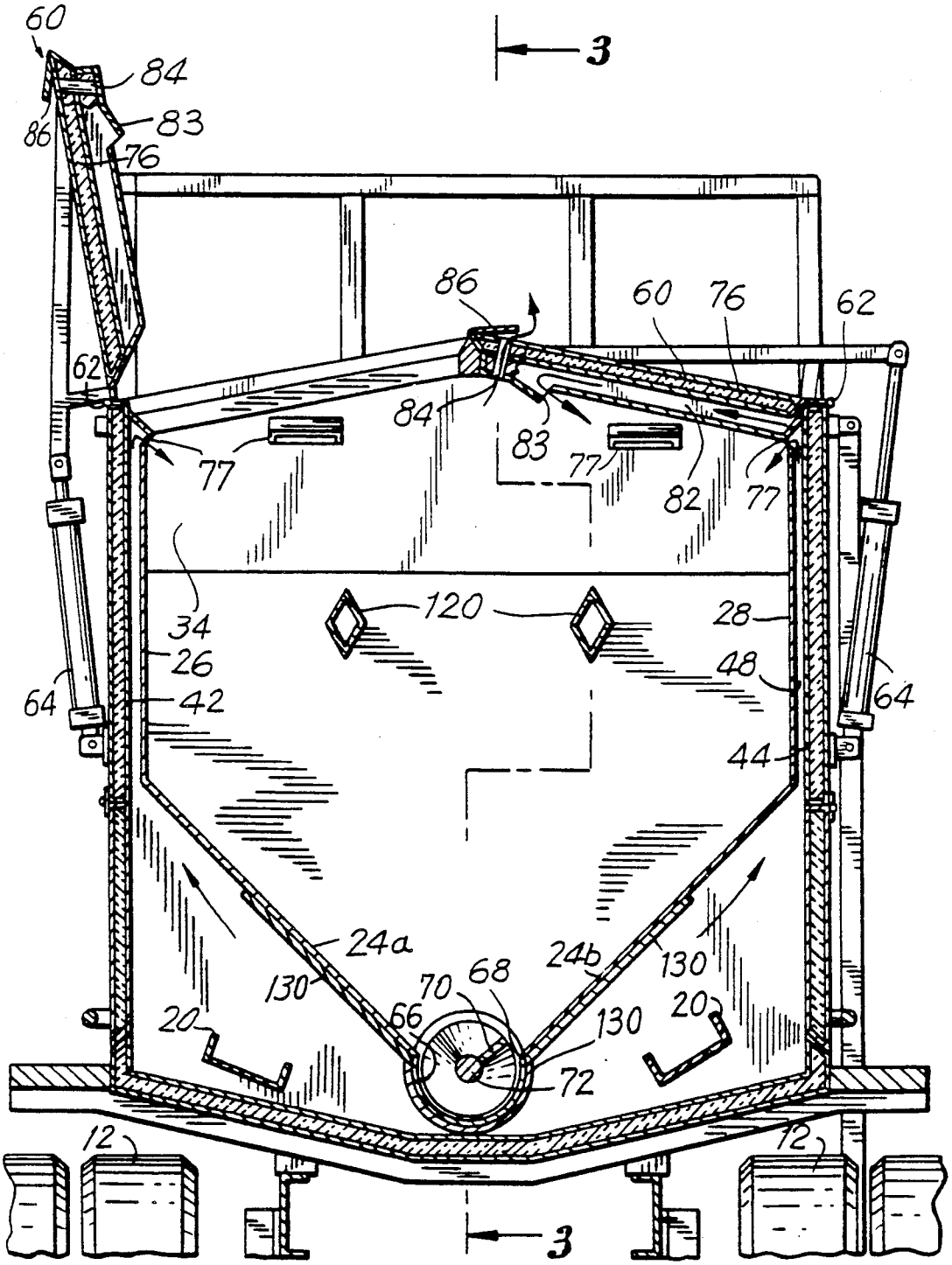
FIG. 2 is a rear elevational view, in cross-section, of the same apparatus taken along the line 2—2 of FIG. 1.

In the center of the inner enclosure floor at the bottom of the sloping portions 24*a* and 24*b* is a circular tubular channel 66 having an upper longitudinal slit 68 so that the channel communicates with the inner volume 16 of inner enclosure 14. Disposed in the channel 66 is a screw 70 mounted at its respective ends to front end wall 32 and rear end wall 30. The screw has a shaft 72 which extends through the front end wall 32 of the inner enclosure and through front end wall 54 of the outer enclosure where it has mounted thereon an appropriate gear **72*a* which is driven by a motor 74 through a chain or other drive means. The screw is preferably driven to push asphaltic material backwards in the channel where it is removed in a manner to be described later. In addition to moving the asphaltic material, the screw serves to mix the material in the channel 66. The bottom of the tubular screw channel is spaced from the floor 36 of the outer enclosure to enable air to flow from one side of the unit to the other in the lower gas space 38**. (See FIG. 2).

The floor, walls and loading doors of the outer enclosure 18 are preferably all of double construction, namely comprised of spaced plates with thermal insulation 76 filling the gap between the plates, to minimize heat loss from the interior of the unit 10. Although generally spaced from the surrounding enclosure 18 to provide the aforementioned gas space and passages, the inner enclosure 14 is fixedly mounted within and secured to the enclosure 18 by suitable support structure (not shown).

The gas space 38 communicates with the external atmosphere, for example through louvered slits (not shown) for supply of air to the gas space. As hereinafter further explained, air heated within the gas space by the infrared converters or sources 20 rises through the gas passages between the inner and outer enclosure walls, contributing to the desired heating of the asphaltic material within the volume 16 as well as minimizing the thermal gradient across the walls of the inner enclosure 14 to retard heat loss from the contained material when the latter material is heated. The gas passages communicate with the volume 16 through louvers 77 spaced around the uppermost portion of the side walls and the front and back walls of the inner enclosure. The louvers direct hot air from the wall gas passages downwardly toward the lowermost portion of the volume 16. Further, each side wall 26 and 28 of the inner enclosure has a plurality of apertures 80 spaced along its length at the top edge thereof. Each of the loading doors 60 has a respective plurality of channels 82 which communicate with the plurality of apertures 80 when the door 60 is closed to enable air to flow through the channels 82 and out from the door downwardly through louvers 83 formed on the underside of the doors 60. Outlets 84 are in communication with louvered vents 86 on the top of the doors for discharging gas to the atmosphere from the volume 16. The apertures 80, channels 82 and louvers 83 are so arranged that heated gas (air) rising through the wall passages 46 and 48 flows therefrom through the apertures 80, channels 82 and louvers 83 into the volume 16 and across the upper surface of the body of asphaltic material contained therein, further contributing to the heating of that material. The air provided to the inner volume through side louvers 77 and top louvers 83 eventually exits the unit 10 to the atmosphere through the outlets 84 and the louvered vents 86.

At the floor of the inner enclosure in communication with the screw channel 66 is an opening 88 in communication with an outlet passage 90 formed in the floor of the outer enclosure 18. Beneath passage 90 is a guillotine-type sliding door 92 (having insulation 93 on its underside) which when open allows asphaltic material driven backward by the screw 70 to be dropped out into passage 90, into a funnel section 94 and into a discharge channel 96 having a power driven screw 98 mounted therein. The channel 96 is formed in a first discharge tube 100 which is mounted on pin 102 so that the tube 100 can swivel 180° around pin 102. The tube 100 has a discharge opening 104 at its end to allow material to drop to the ground. The pin 102 is supported on mount 105. Also provided is a second discharge tube 106 connected to first discharge tube 100 by hinge 107 and provided with screw 108. The second discharge tube 106 can be lowered from the vertical position shown (in FIG. 3) to the horizontal position coaxial with the first discharge tube 100. The screw 108 will mate with screw 98 through a drive coupling arrangement so that a motor which drives screw 98 will also drive screw 108, and material will be driven by both screws 98 and 108 to exit out of end 109 of the second discharge tube 106. Due to the swivel mount of first discharge tube 100 on pin 102, the two tubes 100 and 106 may swivel 180° to direct material anywhere in a 180° semicircle at the back of the unit 10. The tubes will typically be operated by swiveling the tubes back and forth from right to left and so on to fan the material out over an area as the unit 10 is moved forward, for example.

The unit thus provides means for automatically discharging hot asphaltic material by simply opening the door 92, engaging the screw drive motor 74 and a similar motor for discharge screw 98. The downward sloping floor portions **24*a* and 24*b* will gravity feed the asphaltic material into the screw channel 66 for driving by the screw 70**.

In accordance with the invention, the unit 10 further includes a plurality of heating chambers 110, projecting upwardly from the inner enclosure floor portions **24*a* and 24*b* to the upper portion of the volume 16 (but terminating below the uppermost portion of the inner enclosure 14) and extending from side to side of the inner enclosure in lengthwise spaced, parallel relation to each other so as to divide the volume 16 lengthwise into plural parallel subvolumes opening upwardly into a common space through which the gas flow circulates. Five such heating chambers 110 are shown in the illustrated embodiment of the invention, dividing the volume 16 into six relatively narrow subvolumes 16-1, 16-2, 16-3, 16-4, 16-5 and 16-6 each extending laterally of the unit 10**.

Figure 3:
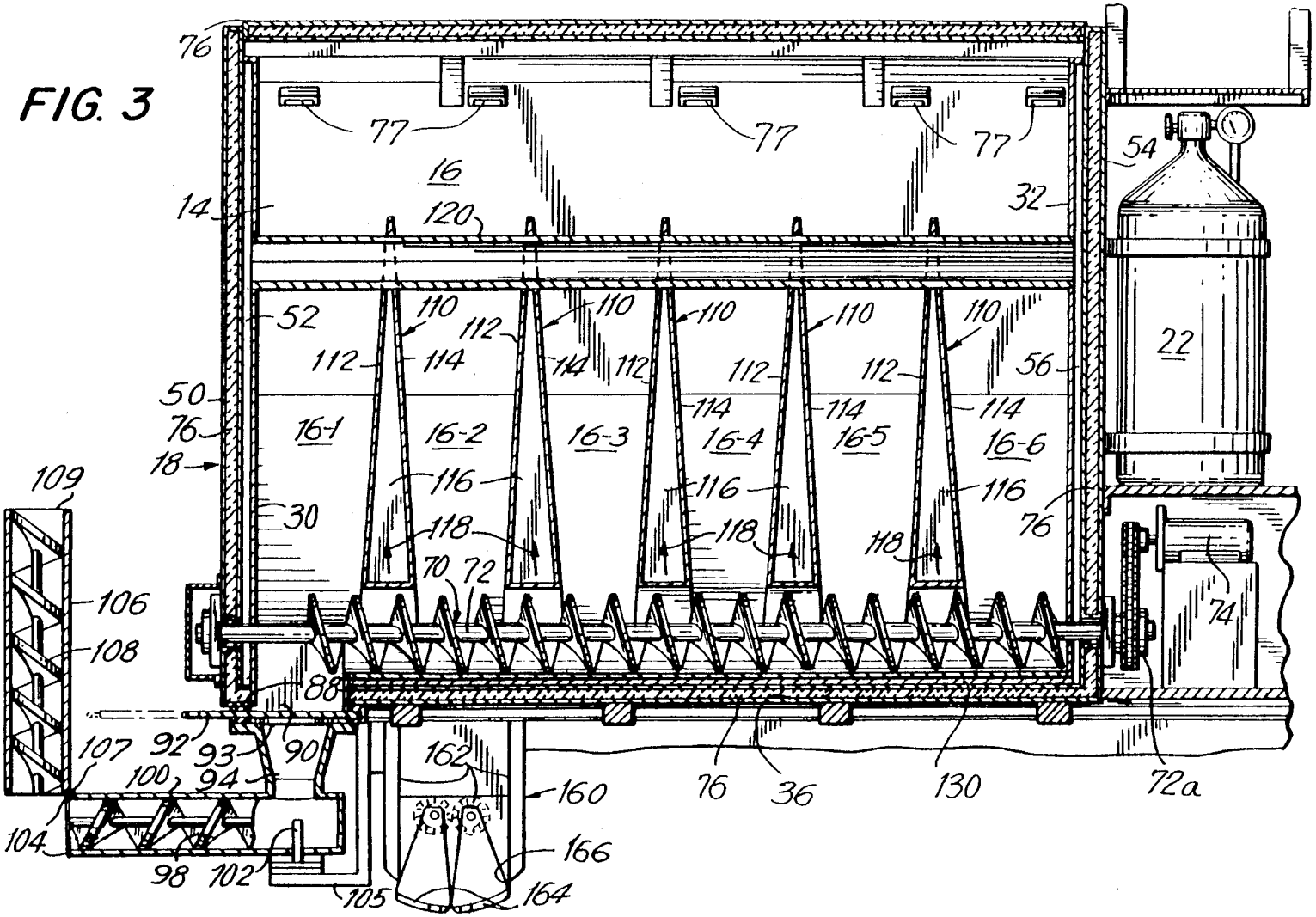
FIG. 3 is a side sectional elevational view taken along the line 3—3 of FIG. 2.

Each of the heating chambers 110 is formed by two walls 112 and 114 which constitute part of the wall structure of the inner enclosure 14 and are fabricated (like the remainder of the inner enclosure) of a thermally conductive metal. These walls converge upwardly so that the heating chamber they cooperatively constitute has an inverted V shape as seen in transverse section (FIG. 3). The walls 112 and 114 of each heating chamber define, between them, a gas flow region 116 which opens downwardly through the inner enclosure floor 24 into the gas space 38 from the side wall 26 to the side wall 28 of the inner enclosure; these walls 102 and 104 are joined to the side walls 26 and 28 and to the floor 24 to isolate the region 116 from the volume 16. It will be appreciated that asphaltic material within the volume 16 is in contact with the walls 112 and 114 of the five heating chambers 110. The unit 10 has six of the infrared energy converters 20 disposed in the gas space 38 directly beneath the gas flow regions of the five heating chambers 110, so that gas (i.e. air) heated by the converters rises from the gas space 38 directly into the gas flow regions of the heating chambers, as indicated by arrows 118. The heated gas also rises from the gas space 38 directly into the end passage 56, and into the side wall passages 46 and 48. Of course, a different number of heating chambers 110, and energy converters 20 may be provided, the number depending at least partly on the size of the unit 10.

Further in accordance with the invention, lengthwise flues 120 (also fabricated of a thermally conductive metal) extend across the interior of the inner enclosure 14, at an upper level therein, for interconnecting the uppermost portions of the gas flow regions 116 of the heating chambers 110 with the end wall passages 52 and 56. Two of these flues 120 are provided in the unit 10, at locations spaced along the width of the unit. Heated air rising through the regions 116 is conducted by the flues 120 to the end wall passages and to the side wall passages, where it circulates and finally enters the volume 16 through the apertures 80 into channels 82 in the doors 60, and out of outlets 84 on the underside of doors 60. In this way, a continuous upward flow of heated air is maintained in the heating chamber regions 116 as well as through the wall passages, and the heated air enters the volume 16 through the louvers 77 at the top of the side and end walls and through the louvers 83 in the underside of doors 60.

As a still further feature of the invention, heat-shielding means are interposed between the converters 20 and the portions of the inner enclosure structure (i.e. the portions 24*a* and 24*b* of floor 24 and of heating chamber walls 112 and 114) adjacent the converters, to prevent localized overheating of the material within the volume 16 and thereby to contribute to desired uniformity of heating. In the embodiment illustrated, this shielding means includes layers of thermal insulation 130 mounted underside the floor portions 24*a* and 24*b* on those portions of the external surfaces of the inner enclosure wall structure which are closest to the converters 20, and underside the channel 96. The shielding means prevents heated air in the immediate vicinity of the converters (i.e. that air which is at the highest temperature) from coming into direct contact with the thermally conductive walls of the inner enclosure.

The use of the described unit to prepare asphaltic concrete may now be readily understood. The volume 16 is filled with chunks or other pieces of initially solid asphaltic material at ambient atmospheric temperature; these chunks, for example, may be broken up pieces of asphaltic pavement or other suitable starting material for the production of asphaltic concrete. The burners heating the converters 20, fueled by propane gas from one of the tanks 22, are turned on and operated, under control of a suitable thermostat system (not shown). U.S. Pat. No. 4,445,848 discloses a control system which is used in the preferred embodiment and is incorporated by reference herein. Air entering the gas space 38 is heated by the infrared energy produced by the converters. The heated air rises from the converters through the regions 116 of the heating chambers 110 and through the forward gas passage 56. Because the heating chambers 110 are reduced in cross-section in the upper region, the heated air which rises will increase in flow, thus enhancing the overall air flow. From the upper portions of the heating chamber regions the heated air flows lengthwise through the flues 120, thence through the end wall passages 52 and 56 and then the side wall passages 46 and 48, and finally enters the upper portion of the volume 16 where it flows across the top surface of the asphaltic material being heated before leaving the unit through the vents 86.

Figure 4:
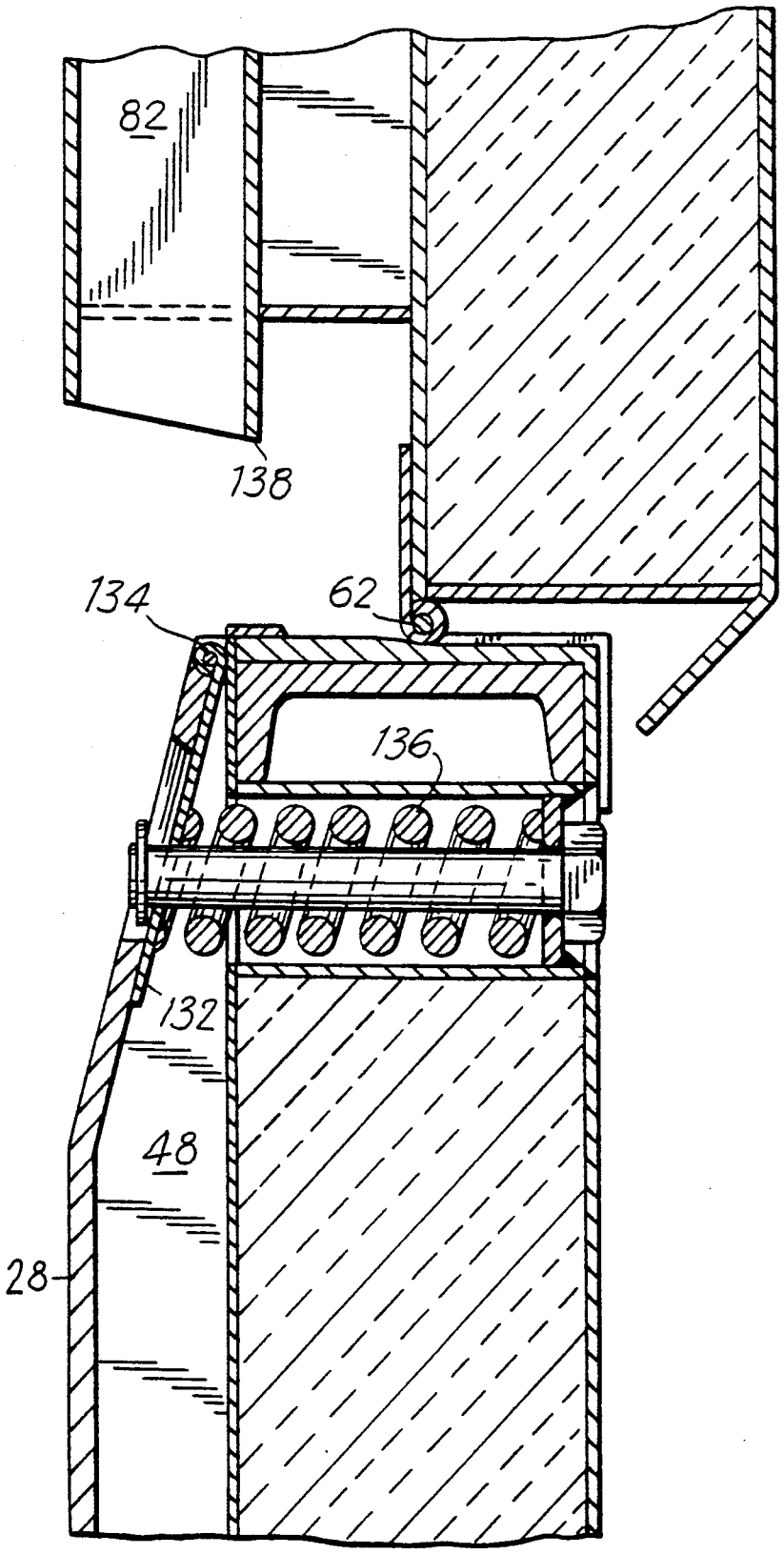
FIG. 4 is a sectional elevational view of the area where the top door is hinged to the sidewall, showing the door open.
Figure 5:
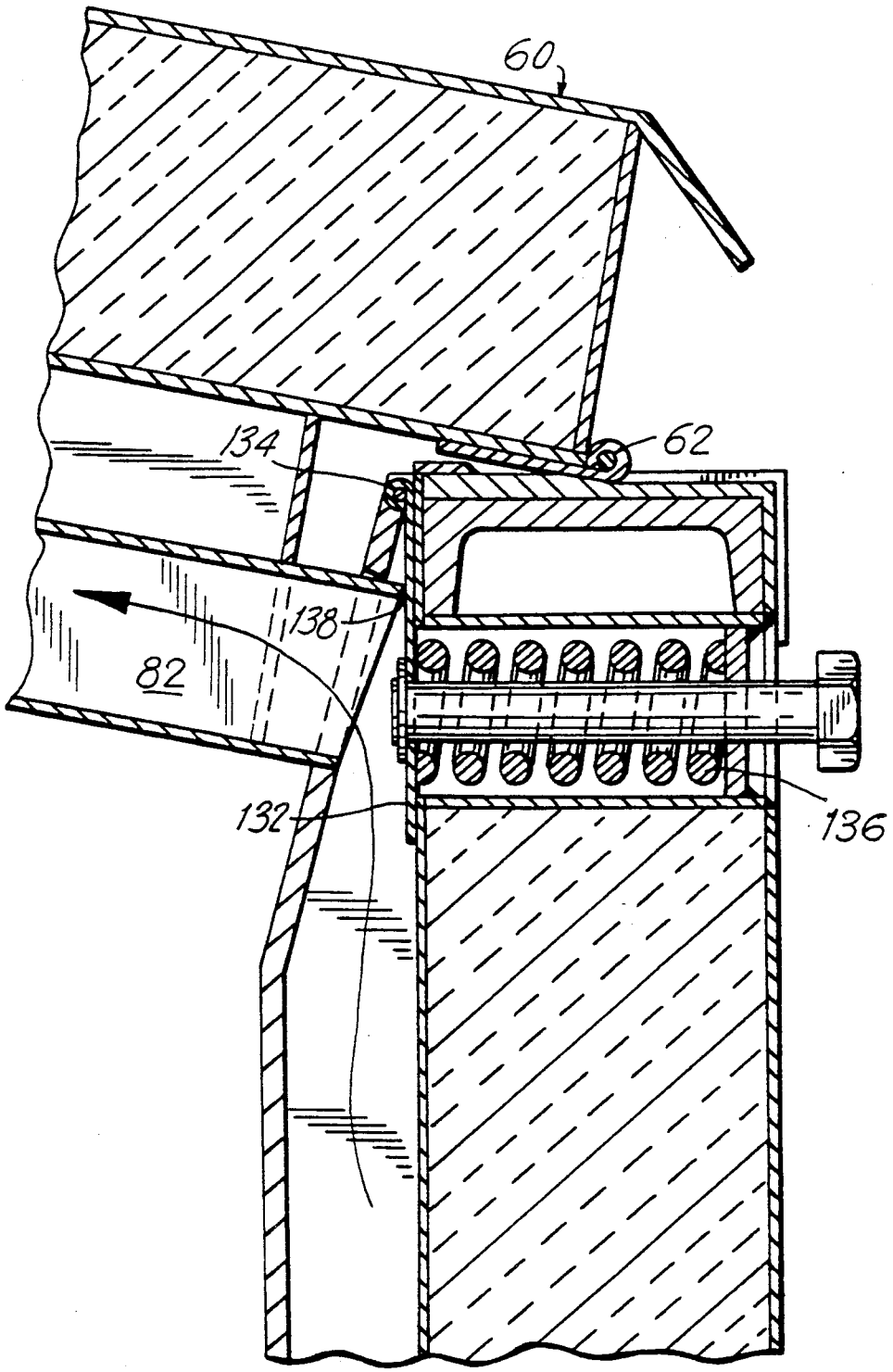
FIG. 5 is a sectional elevational view as in FIG. 4, but wherein the door is closed.

FIGS. 4 and 5 show in more detail the arrangement according to the invention for communicating air from the side wall passages 46 and 48 to the channels 82 in the doors 60. In FIG. 4, one door 60 is shown attached to the side of the unit by hinge 62. The door 60 includes lower walls to define a channel 82. The inner enclosure side wall 28 has an aperture 80 which is covered by an air transfer gate 132 hinged at 134 and biased closed by spring 136. When the doors 60 are open, asphaltic material may be loaded into the inner region 16 and the air transfer gate 132 will prevent the material from entering the side wall passages 46 and 48. Also, because the louvers 77 of the side wall and back and front end walls, and the louvers 83 on the underside of the doors 60 are directed downward when asphaltic material is loaded in the unit (the doors 60 also serving a funneling function during loading), the material is prevented from entering the side passages, front and back passages, and door channel 80. When the doors 60 are closed as shown in FIG. 5, the edge 138 will urge the air transfer gate 132 open, so that side passage 48 will communicate with channel 82.

The lower part of the outer enclosure side walls and 44 have swinging latchable doors 140 which enable an operator to access the gas region space between the inner and outer enclosures.

The unit is also provided with a ladder 150 which is pivotally attached at its top to a platform 152. An operator can reach the platform 152 by climbing the ladder and have access to the inner volume of the inner enclosure for inspection or the like when the top doors 60 are open. The ladder is pivotally attached at its top to enable access to the gas tanks 22.

The unit 10 is further provided with a wastes bin 160 which can receive waste asphaltic material after paving or patching operations by workers shoveling the waste material through side openings 162. The waste material can be dumped at the end of the day for example by opening retractable clamshell doors 164 which cover opening 166.

The converters 20, conveniently under thermostatic control as aforesaid, are operated to achieve and maintain temperature between 275° F. and 300° F. throughout the body of asphaltic material in the volume 16. This heating is accomplished in the described unit with advantageous effectiveness and uniformity of temperature, since the charge of asphaltic material is subdivided or penetrated by the heating chambers 110 with their regions 116 of upwardly flowing heated air, as well as being surrounded by flows of heated air (in the adjacent gas space 38, the wall passages, and the upper portion of volume 16), and since the heat-shielding means prevents local overheating of the portions of the charge nearest the converters. The slow, uniform heating of the material to a temperature in the 275°-300° F. range (max. 320° F.), afforded by the present unit, produces (from an initially cold charge) asphaltic concrete in a suitable state or condition for use within a reasonable period of time, and avoids such problems of prior practice as excessive heating, burning, oxidizing, and/or segregating components of the asphaltic concrete. Moreover, the unit readily enables maintenance of the asphaltic concrete within the stated temperature range until the material is used. Thus, for example, a unit of the described construction having a 8.8-ton capacity and six 50,000 B.T.U. infrared-type converters may be charged with cold material at the end of a working day, and operated overnight (for a period of, say, 12 to 14 hours) to heat the material; by the next morning, the asphaltic concrete will be at the desired temperature and ready for use, and will be maintained at that temperature by the unit.

The lengthwise flues 120, providing paths at the top of the heating chamber regions 116 for outflow of heated air rising through the latter regions, assure continuous directional flow of heated air upwardly through the regions 116 as well as constituting, in themselves, additional heated air passages extending through the volume 16, and therefore contribute to the even and efficient heating of the asphaltic concrete charge. In the particular unit described, the provision of five heating chambers 110 and two lengthwise flues 120 affords effective heating of a full day's supply of asphaltic concrete for patching purposes or the like in a structure conveniently dimensioned for transport as a vehicular trailer.

It is to be understood that the invention is not limited to the features and embodiments hereinabove specifically set forth, but may be carried out in other ways without departure from its spirit.

What is claimed is:

1. An asphalt reclamation unit for heating initially solid asphaltic material for ambient atmospheric temperature to an elevated temperature between about 275° F. and about 300° F. and thereafter maintaining the material at the elevated temperature to provide asphaltic concrete in a condition suitable for paving or patching applications comprising:

(a) an upwardly open inner enclosure defining a volume for containing asphaltic material to be heated, and including a floor, end walls, and side walls;

(b) an outer enclosure surrounding said inner enclosure and including a floor, end walls, and side walls respectively disposed in spaced relation to the floor, end walls, and side walls of said inner enclosure to define a ga space between at least a portion of the inner and outer enclosure floors and end and side wall gas passages between the inner enclosure walls and the other enclosure walls respectively adjacent thereto, said other enclosure further comprising door means for closing the top of the unit, said gas space communicating with the outside atmosphere, said passages communicating with said gas space and being vented to the outside atmosphere, for enabling continuous air flow into said gas space and thence through said passages and thence to the outside atmosphere;

(c) at least one source of energy disposed in said gas space for heating air entering said gas space form the outside atmosphere;

(d) conveyor means disposed at the floor of the inner enclosure for transporting asphaltic material across at least a portion of said inner enclosure floor; and (e) means defining an opening in the floor of the inner enclosure, and passage means in and through the floor of the outer enclosure, to provide an outlet communication passage for delivery of said asphaltic material from the conveyor means to the exterior of said unit.

2. A unit as defined in claim 1, wherein said conveyor means comprises a screw disposed in a tubular channel formed in the floor of said inner enclosure.

3. A unit as defined in claim 2, wherein the tubular channel is open at its top at selected portions along its entire length to receive asphaltic material along the selected potions of the entire length thereof.

4. A unit as defined in claim 2, wherein said screw extends from the front to the back of said unit.

5. A unit as defined in claim 2, further comprising heat shielding means on the underside of the tubular channel.

6. A unit as defined in claim 1, further comprising a sliding door located on the exterior bottom of said outer enclosure for opening and closing said passage means to the exterior of said unit.

7. A unit as defined in claim 6, further comprising insulative material on said sliding door.

8. A unit as defined in claim 1, wherein the conveyor means comprises a motor means for driving the conveyor means.

9. A unit as defined in claim 1, further comprising a discharge screw means for receiving material through the floor opening and for discharging the material to the exterior of the unit.

10. A unit as defined in claim 9, further comprising a swivel mount for said discharge screw means.

11. A unit as defined in claim 10, wherein the discharge screw means comprises two discharge screw tubes each housing a discharge screw, wherein the tubes are hingedly connected to provide selective communication of said tubes and coengagement of said discharge screws for coactive driving of material through both tubes.

12. A unit as defined in claim 1, further comprising a wastes bin in the bottom of said unit for receiving and storing waste asphaltic material.

13. A unit as defined in claim 12, wherein the wastes bin has an opening covered by retractable doors.

14. A unit as defined in claim 1, wherein said sidewalls of said inner enclosure are in adjacent spaced relation to the side walls of said outer enclosure, and wherein the floor of said inner enclosure is downwardly sloping to define a lower gas space between the floor and lower bottom of said sidewalls of said outer enclosure and the downwardly sloping floor of the inner enclosure.

15. A unit as defined in claim 14, further comprising heat shielding means between the lower gas space and the downwardly sloping floor of the inner enclosure.

16. A unit as defined in claim 1, further comprising door means on the outer enclosure sidewalls on the lower bottom thereof for access to the gas space.

17. A unit as defined in claim 1, further comprising heating chamber means comprising:

(a) at least one heating chamber projecting upwardly from the floor of the inner enclosure into an upper portion of said volume at a locality intermediate and spaced from the end walls of said inner enclosure, said one heating chamber extending from side to side of said inner enclosure and comprising thermally conductive wall portions of said inner enclosure defining a gas flow region isolated by the wall portions from said volume and opening into and extending upwardly from said gas space above said energy source; and (b) flue means, comprising at least one flue extending from end to end of said inner enclosure and spaced from both sides thereof, for conducting heated air from the uppermost portion of said gas flow region frontwardly and rearwardly across said upper portion of said volume to said end wall passages, such that air heated by said source flows upwardly through said gas flow region and thence through said flue means to the end wall passages; and (c) said walls of said inner enclosure, said heating chamber means, and said flue means being mutually disposed to enable delivery of solid pieces of the asphaltic material downwardly from the top of the unit into the lowermost portion of said volume.

18. A unit as defined in claim 17, wherein said heating chamber means comprises a plurality of heating chambers projecting upwardly from the inner enclosure floor into said volume in spaced relation to each other, each of said heating chambers extending from side to side of said inner enclosure and comprising thermally conductive wall portions of said inner enclosure defining said gas flow region, and a corresponding plurality of sources of energy respectively disposed beneath the gas flow regions of the heating chambers, said flue means comprising means for conducting heated air from the uppermost portion of each of the gas flow regions to the wall passages as aforesaid.

19. A unit as defined in claim 17, wherein said flue means comprises a plurality of flues extending from end wall to end wall of said inner enclosure in horizontally spaced relation to each other, each of said flues communicating with each said gas flow region.

20. A unit as defined in claim 17, wherein there are five heating chambers and two flues.

21. A unit as defined in claim 1, wherein at least one aperture is defined in the top of at least one wall in communication with the gas passage of said one wall, and further comprising a gas passage channel formed in the door means, said gas passage channel communicating with the wall gas passage through the aperture when the door means is closed.

22. A unit as defined in claim 21, further comprising an air transfer gate means for closing the aperture in the wall when the door means is open, to thereby to seal off the wall gas passage from asphaltic material.

23. A unit as defined in claim 1, wherein a gas space is provided between the inner and outer enclosure floors and wherein the conveyor means is disposed along the center of the floor of the inner enclosure to thereby enable hot air to flow beneath the conveyor means from one side of the inner enclosure floor to the other side.

24. A unit as defined in claim 1, further comprising louver duct means formed in the side walls of the inner enclosure to direct hot air flow from the passageways between the side walls of the inner and outer enclosure to the inner volume of the inner enclosure, and for inhibiting asphaltic material from entering said passageways.

25. An asphalt reclamation unit for heating initially solid asphaltic material from ambient atmospheric temperature to an elevated temperature between about 275° F. and about 300° F. and thereafter maintaining the material at the elevated temperature to provide asphaltic concrete in a condition suitable for paving or patching applications, comprising:

(a) an upwardly open inner enclosure defining a volume for containing asphaltic material to be heated, and including a floor, end walls, and side walls;

(b) an outer enclosure surrounding said inner enclosure and including a floor, end walls, and side walls respectively disposed in spaced relation to the floor, end walls, and side walls of said inner enclosure to define a gas space between at least a portion of the inner and outer enclosure floors and at least one gas passage between the inner enclosure walls and the outer enclosure walls respectively adjacent thereto, said outer enclosure further comprising door means for closing the top of the unit, said gas space communicating with the outside atmosphere, said passage communicating with said gas space and with the uppermost portion of said volume, and said uppermost portion of said volume being vented to the outside atmosphere, for enabling continuous air flow into said gas space and thence through said passage and said upper portion of said volume;

(c) at least one source of energy disposed in said gas space for heating air entering said gas space from the outside atmosphere; and (d) means, located in the uppermost portion of said volume, on the door means, for directing heated air from said gas passage downwardly into said volume, to thereby aid heating of asphaltic material located in said volume.

26. A unit as defined in claim 25, wherein end and side wall gas passages are defined between the inner enclosure walls and outer enclosure walls respectively adjacent thereto.

27. A unit as defined in claim 26, wherein said means for directing heated air comprises a plurality of openings defined in the side walls in communication with said side wall gas passages and louver means mounted on the side walls over said openings to direct heated air from said side wall gas passages downwardly into said volume.

28. A unit as defined in claim 26, wherein said means for directing heated air comprises a plurality of openings defined in the end walls in communication with said end wall gas passages, and louver means mounted on the end walls over said openings to direct heated air from the end wall gas passages downwardly into said volume.

29. A unit as defined in claim 26, wherein the door means has an inner wall and an outer wall to define at least one gas passage therein, said door gas passage being in communication with at least one side gas passage to receive heated air therefrom, said door means defining an opening on the inner wall, and further comprising louver means mounted on said inner wall for directing heated air from the door gas passage downwardly into said volume.

30. An asphalt reclamation unit for heating initially solid asphaltic material from an ambient atmospheric temperature to an elevated temperature between about 275° F. and about 300° F. and thereafter maintaining the material at the elevated temperature to provide asphaltic concrete in a condition suitable for paving or patching applications, comprising:

(a) an upwardly open inner enclosure defining a volume for containing asphaltic material to be heated, and including a floor, end walls, and side walls;

(b) an outer enclosure surrounding said inner enclosure and including a floor, end walls, and side walls respectively disposed in spaced relation to the floor, end walls, and side walls of said inner enclosure to define a gas space between at least a portion of the inner and outer enclosure floors and end and side wall gas passages between the inner enclosure walls and the outer enclosure walls respectively adjacent thereto, said outer enclosure further comprising door means for closing the top of the unit, said gas space communicating with the outside atmosphere, said passages communicating with said gas space and being vented to the outside atmosphere, for enabling continuous air flow into said gas space and thence through said passages and thence to the outside atmosphere;

(c) at least one source of energy disposed in said gas space for heating air entering said gas space from the outside atmosphere;

(d) a conveyor screw disposed in a circular tubular channel formed in the floor of the inner enclosure for transporting asphaltic material across at least a portion of said inner enclosure floor; and (e) means defining an opening in the floor of the inner enclosure, and passage means in and through the floor of the outer enclosure, to provide an outlet communication passage for delivery of said asphaltic material from the conveyor screw to the exterior of said unit.

* * * * *